US007654272B2

(12) United States Patent
Thiebaut

(10) Patent No.: US 7,654,272 B2
(45) Date of Patent: Feb. 2, 2010

(54) DEVICE FOR PACKAGING AND APPLYING AT LEAST TWO PRODUCTS, IN PARTICULAR TWO MAKEUP PRODUCTS

(75) Inventor: Laure Thiebaut, Clichy (FR)

(73) Assignee: L'Oreal, Paris (FR)

( * ) Notice: Subject to any disclaimer, the term of this patent is extended or adjusted under 35 U.S.C. 154(b) by 516 days.

(21) Appl. No.: 11/211,652

(22) Filed: Aug. 26, 2005

(65) Prior Publication Data

US 2006/0169298 A1 Aug. 3, 2006

Related U.S. Application Data

(60) Provisional application No. 60/608,885, filed on Sep. 13, 2004.

(30) Foreign Application Priority Data

Aug. 27, 2004 (FR) ..... 04 51922

(51) Int. Cl.
*A45D 2/00* (2006.01)

(52) U.S. Cl. ..... 132/295

(58) Field of Classification Search ..... 132/293–295, 132/298, 300, 316, 317, 286, 287; 206/581, 206/823; D28/76, 77, 83
See application file for complete search history.

(56) References Cited

U.S. PATENT DOCUMENTS

| | | | | |
|---|---|---|---|---|
| 1,360,739 | A | 11/1920 | Harman | |
| 3,502,089 | A * | 3/1970 | Paradis | 132/294 |
| 3,760,820 | A | 9/1973 | Seidler | |
| 4,807,773 | A | 2/1989 | Tsai | |
| 5,226,541 | A * | 7/1993 | Huang | 206/581 |
| 6,298,863 | B1 | 10/2001 | Byun | |
| 6,302,120 | B1 * | 10/2001 | Kuo | 132/295 |
| 6,694,987 | B2 | 2/2004 | Thiebaut | |
| 2002/0108629 | A1 * | 8/2002 | Thiebaut | 132/297 |

FOREIGN PATENT DOCUMENTS

| | | |
|---|---|---|
| DE | 93 12 681.6 | 11/1993 |

(Continued)

OTHER PUBLICATIONS

U.S. Appl. No. 11/484,684, filed Jul. 12, 2006, Thiebaut.

*Primary Examiner*—Robyn Doan
*Assistant Examiner*—Rachel R Steitz
(74) *Attorney, Agent, or Firm*—Oblon, Spivak, McClelland, Maier & Neustadt, L.L.P.

(57) ABSTRACT

A device for packaging and applying at least one cosmetic product, in particular makeup. According to a disclosed example, the device includes a body incorporating a first platen delineating at least one first recess containing a first product. A second platen is directly coupled to the first platen and delineates at least one second recess containing a second product. An applicator component includes an applicator element arranged at the end of a handle, and the applicator component is detachably mounted to the body. With the applicator component in the mounted position on the body, the first platen is immobilized relative to the second platen. When the applicator component is detached, the first platen is movable relative to the second. In the mounted position, the first platen covers the second opening and the handle covers the first opening.

52 Claims, 3 Drawing Sheets

FOREIGN PATENT DOCUMENTS

| | | | |
|---|---|---|---|
| EP | 0 261 750 | A2 | 3/1988 |
| EP | 0 960 582 | A1 | 12/1999 |
| FR | 1.020.647 | | 6/1950 |
| FR | 2 759 872 | | 8/1998 |
| FR | 2 820 293 | A1 | 8/2002 |
| FR | 2 835 159 | A1 | 8/2003 |

* cited by examiner

DEVICE FOR PACKAGING AND APPLYING AT LEAST TWO PRODUCTS, IN PARTICULAR TWO MAKEUP PRODUCTS

CROSS-REFERENCE TO RELATED APPLICATIONS

This document claims priority to French Application. Number 04 51922, filed Aug. 27, 2004 and U.S. Provisional Application No. 60/608,885, filed Sep. 13, 2004, the entire content of which are hereby incorporated by reference.

FIELD OF INVENTION

The invention provides an applicator device as used in particular in the field of cosmetics. In a preferred example, the invention can be used for packaging and applying certain makeup or skin care products, such as eyeshadows, blushers, lip colors, mascaras or foundations.

BACKGROUND OF INVENTION

Discussion of Background

Generally speaking, makeup products are applied either by means of an applicator or directly with the fingers. Due to their relatively small dimensions the applicators are sometimes difficult to find, particularly in a handbag. Moreover, applicators have to be protected against dust or other contaminants present in the handbag and, conversely, applicators must be prevented from soiling the contents of the handbag. For all these reasons, the applicator is often protected inside a compartment either separate from or forming part of a packaging device for the product to be applied, for example in a case. In the latter instance, so as not to unduly increase the size of the case, the applicator is often of very small dimensions thus making it more difficult to handle.

U.S. Pat. No. 3,760,820 describes an applicator device for a makeup product including a first part delineating a first recess designed to receive a product to be applied. The first recess includes an opening, opposite a bottom, and extending substantially in one plane. The first part also includes a second recess designed, when the first and second parts are in the assembled position, to receive an applicator element. The applicator device additionally includes a second part incorporating the applicator element at the end of a handle. In the assembled position, the handle covers the opening of the first recess, and the applicator element is arranged in the second recess on the same side of the plane as the first recess.

One of the major drawbacks of this configuration lies in the complexity of the actions required to assemble the two parts. In fact, assembly is accomplished by a combined movement on the axis of the device on one hand, and a pivoting action about a moving point on the other. Aside from the complexity, these actions risk damaging the applicator, both when withdrawing the applicator and when replacing it after applying the product. In addition, a device so configured can be fragile.

Document FR-2,835,159 describes a compact device including two juxtaposed cups held in a body which are accessible by lifting a cover hinged on the body and removing applicators concealing the access to these cups.

Other configurations of the same type are described in documents FR-B-1,020,647, FR-A-2,759,872, and in EP-A-0,261,750. All of these documents describe devices that suffer from a major drawback. In fact, to open the recess containing the product for the purpose of taking up product using the applicator, and to grasp the applicator, requires a minimum of two successive actions or even more, and it is not necessarily a simple matter to combine this sequence of movements. Generally, a sliding movement is required to withdraw the applicator, or to release its application part, and a pivoting movement of a cover is needed to open the recess containing the product. When the device includes a mirror to facilitate application, at least three actions are needed. Moreover, in many of these documents, the size of the applicator is very small, thereby rendering it even more difficult to handle.

Document FR-B-2,820,293 also describes a compact device including a first part having a recess in which a single cup of cosmetic product is held. A second part includes an applicator portion, with this second part being capable of closing the recess when the two parts are in an assembled position.

However, in such known makeup applicators, space is provided for a maximum of two cups each generally containing a single makeup. Sophisticated makeup generally calls for the application of a combination of different shades whereby the user can achieve a multitude of different effects, imparting an effect to the finished makeup that is greater than the simple application of a single shade. Cups are known in which several shades of makeup are proposed, but with each shade in a quantity so small and on such a limited surface area that the successive take-up of different shades is difficult and calls for undue dexterity on the user's part.

Makeup palettes are also known that include a plurality of cups each containing different shades. Due to the fact that the cups are presented in the same holder, when the user takes up a first shade and moves the loaded applicator over the other cups, part of the makeup held thereon risks contaminating the other shades. After several uses, none of the cups contain a pure shade any longer. It then becomes impossible to reproduce the same initial makeup finish. Furthermore, the palettes are generally cumbersome and need to be placed on a table in the open position and are difficult to grasp in one hand. They are therefore unsuitable for mobile use. Moreover, the presence of a recess for an applicator only serves to increase the dimensions of such palettes. It is generally known to provide applicators separate from these pallets.

SUMMARY OF THE INVENTION

There is therefore a need for a compact device that is nonetheless capable of achieving a sophisticated makeup finish.

One of the objects of the invention is to provide an applicator device which wholly or partially remedies the problems discussed above in reference to conventional applicator devices.

One object of the invention is to provide an applicator device that simplifies the necessary hand actions compared with the actions required by conventional devices.

A further object of the invention is to provide an applicator device that is aesthetically pleasing, simple to use, and economical to make.

A further object of the invention is to enable the use of an applicator that can be manipulated easily and precisely, and without significantly affecting the overall dimensional characteristics of the device.

Further objects will become apparent from the detailed description which follows.

According to preferred examples of the invention, a packaging and application device is provided for at least one cosmetic product, in particular makeup, which includes a body incorporating a first platen delineating at least one first recess containing a first product. A second platen is directly coupled to the first platen and delineates at least one second recess containing a second product. An applicator component incorporates an applicator element arranged at the end of a handle, with the applicator component being capable of being mounted in a detachable manner relative to the body. In addition, the device is configured so that, with the applicator component in the mounted position on the body, the first platen is immobilised relative to the second, and so that in the absence of this applicator component, the first platen is movable relative to the second.

The expression "directly coupled" is to be understood to mean that the platens respectively presenting the recesses are movable relative to each other, with each having counterpart arrangements enabling them to mutually cooperate and allow movements of the first platen relative to the second platen. These counterpart arrangements are capable of coming into direct contact with each other. The expression "directly coupled" is also understood to mean that there is no need for an intermediate structure to connect the platens together, although such a structure can be provided. The movements are preferably limited to movements between two positions such that in a first position the two platens are superimposed, whereas in a second position the two platens are offset. In the first position, at least one of the recesses in one of the platens is rendered inaccessible by the presence of the other of the platens. In the offset position, at least one recess in each platen is accessible, allowing the product contained therein to be taken up.

The invention also provides a packaging and application device for at least one cosmetic product, in particular makeup, which includes a first platen delineating a first recess containing a first product to be applied, with the first recess incorporating a first opening. A second platen is movable relative to the first platen and delineates at least one second recess containing a second product to be applied, with this second recess incorporating a second opening. In addition, a detachable applicator component is provided which includes an applicator element arranged at the end of a handle. Further, with the platens and applicator component in the assembled position, the first platen covers the second opening and the applicator component covers the first opening.

This arrangement of the handle of the applicator component and the position of the applicator element in the assembled configuration of the first and second platens contributes significantly towards simplifying the aforementioned hand actions. More specifically, the configuration according to a preferred example of the invention makes it possible to provide a device in which, at least in its simplest version, using of a single hand gesture, the applicator can be grasped in the hand while at the same time allowing access to at least the first product contained in the recess formed by the first platen.

Preferably, the device includes an arrangement preventing assembly of the applicator component with any one of the platens when the second opening is not covered by the first platen, and reciprocally preventing access to this second opening when the device is in the assembled position. This advantageous arrangement serves to avoid inadvertent opening of the second recess in the second platen when the device is in the assembled position. Furthermore, this arrangement requires the user to close off the access to this second recess when it is desired to store the applicator component, for example at the moment when the makeup is complete and the user is obliged to restore the device to the assembled position.

Advantageously, in the assembled position, the device is in a closed position in which the first and second openings are inaccessible. The products respectively contained in the recesses of the device are therefore at no risk of soiling the bag in which such a device may be carried.

Preferably, with the applicator component in a detached position relative to the first platen, at least the first opening is accessible for take-up of the first product. In fact, in a preferred example, detachment of the applicator component relative to the first platen requires no movement between the two platens.

For example, with the applicator component in the detached position relative to the first platen, the second platen can be caused to occupy an offset position relative to the first platen, such that at least the second opening is accessible for take-up of the second product. As a variant, an arrangement can be provided to automatically actuate this second platen relative to the first platen, with this actuating arrangement then being controlled by the disengagement of the applicator component relative to the first platen.

Advantageously, according to a preferred example, the handle defines a portion of the external surface of the device. The device can thus be made from a minimum number of components. In addition, such a device can be opened quickly and manipulated easily.

In a preferred embodiment, the first opening extends substantially in a first plane, and the applicator element is substantially arranged via a third opening in a third recess on one side of this first plane opposite the first recess. The second opening may also extend substantially in a second plane, with this second plane then being preferably parallel to the first plane.

Preferably, a section of the handle in a plane parallel to a plane of the first opening is greater than or equal to the section of the latter, so that the handle can be superimposed on the first opening over the entirety of the section of the latter. Thus, the handle can protect the first product from the outside when it directly covers the first opening. Inside the first recess, the surface of the product may coincide with the plane of the opening. Alternatively, the free surface of the product may protrude or be domed so as to facilitate take-up. In the latter case, the corresponding surface of the handle can be recessed in an appropriate manner to accommodate such a "dome".

Preferably, in the assembled position, the handle closes off the first opening in a leaktight manner. To this end, if desired, a sealing arrangement, in particular of the lip or gasket type, can be used in combination with the handle to improve the sealing tightness of the closure.

Advantageously, and in a complementary manner, a section of the first platen in a plane parallel to a plane of the second opening can be greater than or equal to a section of the latter, so that the first platen can be superimposed on this second opening over the entirety of the section of the latter. The first platen can also be arranged to close off the second opening in a leaktight manner.

If necessary, the applicator component can be used to conceal a mirror, for example mounted fixedly on the first platen, adjacent to the first opening. For example, a mirror can be provided which is concealed by the applicator component around all or part of the first opening, so as to protect the reflective surface against contaminants that would inevitably be deposited thereon were it left unprotected. Such a mirror considerably facilitates the operations involved in applying products such as makeup products. As a variant, the mirror may be capable of occupying a position wherein it at least partially covers the first opening and is movable in relation to the first platen, in particular by a sliding movement, or about an axis perpendicular to the plane of the opening or parallel thereto. Preferably, in the assembled position, the mirror entirely covers the first opening. Arranged thus, and in combination with the handle, it can participate in providing a more effective closure of the recess containing the product to be applied and thereby improve the protection thereof.

Advantageously, according to a preferred example, the device includes a longitudinal axis along which is arranged a first series of recesses formed in the first platen. Preferably, the recesses of the first series themselves extend along the longitudinal axis. This characteristic allows the handle to be made of a sufficient size, in particular length, to render it easy and precise to handle.

Preferably, the second platen includes a second series of recesses, thereby further increasing the number of recesses capable of containing products of different shades. The first platen is preferably superimposed on this second platen, so that the second platen does not significantly alter the length of the device along its longitudinal axis. Furthermore, as the recesses are generally of shallow depth, the presence of this second platen has the advantage of substantially increasing the quantity and diversity of products presented in said device, without however considerably increasing the overall dimensions of the device.

By way of example, the first platen can be formed in one piece obtained by moulding, in particular injection moulding. The same can apply to the second platen and the applicator component. The material used can be an ABS (acrylobutadiene styrene), an SAN (polystyrene acrylonitrile), or a PS (polystyrene). Other materials, such as polyethylene or polypropylene, can be used according to the invention.

The applicator element is preferably fixed axially in relation to the handle. Thus, the applicator component is immediately ready to apply the product without requiring preliminary manipulation.

Also by way of example, a guidance arrangement, in particular of the sliding type, can be provided by virtue of a relative sliding action of the applicator component relative to the platens. Such an arrangement can facilitate the operation of assembly or mounting of the applicator component with the first and second platens. In addition, all or part of the edge of the third recess intended to receive the applicator element can participate in guiding the latter in its sliding movement. The guidance arrangement can also provide reversible locking, in particular by force fitting, of the applicator component with said first and second platens in the assembled position.

In addition, by way of example, a guidance arrangement, in particular of the sliding type, can be provided by virtue of a relative sliding action of the second platen relative to the first platen. Alternatively, a guidance arrangement, in particular of the pivotable type, can be provided by virtue of a relative rotational movement of this second platen in relation to the first platen.

Reversible locking of the assembled position of the applicator component with the first and second platens can be provided by a snap-on attachment or force fit between the component and at least one of the platens. Preferably, this locking action can only be obtained for a defined relative position of the platens, for example when they are perfectly superimposed on each other. More advantageously, one of the platens can include an arrangement forming a stop element preventing the applicator component from being mounted on the other platens when the two platens are not placed in the defined position.

In a preferred embodiment, in the assembled position, the device forms a cylinder or prism, in particular having a circular, hexagonal, square, oval or rectangular cross-section. A device is obtained that has an aesthetic appearance relatively different from that presented by conventional powder or makeup compacts, and which has a closer resemblance to that found in applicator devices for products such as mascaras, lip colors or eye-liners.

By way of example, the applicator element can be composed of a block of open, semi-open or closed-cell foam, felt, agglomerate material, in particular ceramic or thermoplastic, or an arrangement of bristles, in particular in the form of a tuft substantially parallel to the axis of the handle.

The product, for example in the form of a compacted powder, may be contained in a cup arranged inside the first recess. The cup can be detachable thereby rendering the device rechargeable. Alternatively, the cup can be non-detachable, and fixed for example by gluing or welding. As a further alternative, the product can be arranged directly in the recess reserved for that purpose.

The product contained in the recess(es) can be in the form of a solid or semi solid bar. A solid block of this kind can be set directly in the recess in its solid form. Alternatively, the product can be poured hot or cold into the recess, taking up its solid form after the composition has solidified or set. Products packaged in the form of such a solid bar can be for example, an eyeshadow, a foundation, a blusher, or a mascara. In the case of a lip color, the product can be in the form of a paste.

The invention also provides for the use of a device of this kind for packaging and applying a cosmetic product, in particular makeup, such as an eyeshadow, a blusher, a foundation, a lip color, or a mascara.

The applicator device according to the invention can additionally include a second applicator element, for example, a makeup pencil. A second applicator element of this kind can be integral with one of the platens, and be arranged so as to sit in a recess formed by the applicator component in the assembled position.

A further object of the invention is to provide a packaging and application device for at least one cosmetic product, in particular makeup, which includes a body elongated on a longitudinal axis and delineated by two axial ends. The body includes a first platen extending at least partially in a plane and a second platen coupled directly to the first and extending parallel to the plane, such that it includes at least one recess formed by the first and/or the second platen, which contains the cosmetic product. An applicator component incorporates an applicator element arranged at the end of a handle, with the applicator component capable of being mounting in a detachable manner relative to the body. In addition, the device is configured so that, with the applicator component in the mounted position on the body, the first platen is immobilised relative to the second, and so that, in the absence of this applicator component, the first platen is movable relative to the second according to a rotational or pivoting movement about an axis distant or spaced from the ends. The two platens each respectively have at least one recess capable of containing a cup of a product.

As should be apparent, the invention can provide a number of advantageous features and benefits. It is to be understood that, in practicing the invention, an embodiment can be constructed to include one or more features or benefits of embodiments disclosed herein but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

This invention will become further apparent from the following detailed description, particularly when considered in conjunction with the drawings in which.

DETAILED DESCRIPTION OF THE PREFERRED EMBODIMENTS

Figure 1:
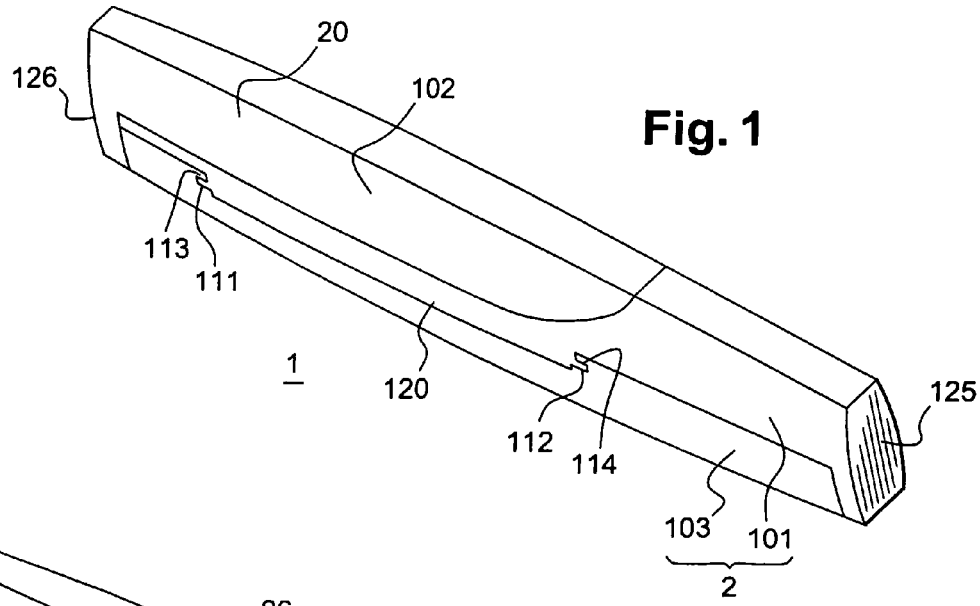
FIG. 1 is a perspective view of a device according to the invention in the assembled position.

In the example of FIG. 1, a device 1 according to the invention includes on one hand a body 2 incorporating at least one first platen 101, and on the other hand a cover 20 incorporating at least one applicator component 102. The body 2 also includes a second platen 103. By way of example, the two platens are preferably made of ABS, with the second platen 103 being integral with the first platen 101.

The first platen 101 includes a first portion 104 (FIG. 3), for example extending over more than half the axial length of the device 1, on a principal axis of elongation X, also referred to as longitudinal axis X, of the device 1, in which a recess 4 is formed. The longer dimension of the device can also be referred to as along a lengthwise direction, while the widthwise direction or width is transverse to the lengthwise direction. In the preferred embodiment depicted in FIGS. 2 and 3, this first portion 104 includes a series 105 of recesses. The series 105 in this instance includes two identical recesses along the axis X.

Inside the first recess 4 of the series 105, a cup such as 5 is arranged via a first opening such as 106 formed in an upper surface 107 of this first portion 104. The cup 5 is made of plastic and contains a solid block of eyeshadow in the illustrated example. Advantageously, the series 105 is used to present makeup of different shades in the different recesses.

Preferably, the upper surface 107 is flat, and substantially corresponds to a sectional plane 6 substantially parallel to the longitudinal axis X. The first opening 106 extends substantially in the sectional plane 6. The recess 4 is substantially parallelepipedic, and this first opening 106 has a cross-section substantially identical to the cross-section of the recess 4 in the illustrated example. The cup 5 can be held by means of a snap attachment inside the recess 4.

At the level of sectional plane 6, the first portion 104 includes a mirror 9 of substantially elongated shape along axis X. Preferably, the series of cups 105 is aligned with the mirror 9 along the axis X.

Along axis X, the first platen 101 includes a second portion 108 adjacent to the first portion 104. This second portion 108 extends over the rest of the axial length of the body 2. This second portion 108 forms a third recess 11 above the sectional plane 6. This third recess 11 extends along axis X, and the opening 12 defining an access to this third recess 11 extends substantially in an oblique plane, or perpendicular to axis X, unlike the opening 106 of first recess 4 which extends in a plane substantially parallel to this axis X. Thus, the opening of the third recess can extend transverse, oblique or perpendicular to the opening of the first recess.

The second platen 103 cooperates with the first platen 101 so as to be capable of being moved from a first position, in which the first platen 101 is superimposed on this second platen, to a second position in which an upper surface 109 of this second platen 103 is no longer concealed by the first platen 101. The first and second platens 101 and 103 participate in defining the external outline of the body 2. Nevertheless, in the first position, a lower surface 110, opposite the upper surface 107, of the first platen bears against the upper surface 109 of the second platen, these surfaces 109 and 110 being in fact inaccessible and not therefore participating in defining the external outline of the body 2.

In the embodiment illustrated in FIGS. 1 to 5, the second platen 103 is arranged to move by a sliding movement relative to the first platen 101, in particular on an axis orthogonal to the axis X in the illustrated example. To this end, the lower surface 110 includes at least two indentations 111 and 112 capable of engaging with counterpart slides 113 and 114 formed on the upper surface 109. Preferably, these slides are arranged in proximity to the axial ends 125 and 126, relative to the longitudinal axis X, of the body 2. The slides and indentations then extend in a direction orthogonally to the axis X.

As a variant, a parallel sliding action of the platens 101 and 103 can also be provided along the axis X such that, in the open position, the length of the device 1 is substantially greater than its length in the closed position. Accordingly, the sliding movement of the second platen relative to the first platen can be in various directions, e.g., in a lengthwise direction of the device or in a widthwise direction.

To improve the guidance of this sliding action between the indentations and their respective slides, the second platen 103 presents at least one rail 115 engaging with a slot 116 in the first platen 101. This rail 115 is preferably formed between the two slides 113 and 114.

More preferably, the body 2 is arranged to restrict the movements of the second platen relative to the first platen to movements between a first and a second position. Thus, the first and second platens can remain integral or connected with one other. In particular, from the first position to the second position, the movement is limited by cooperation between a stop 117, shown in FIG. 5, formed at the upper surface 109 and brought to bear against a flange 119 on the lower face 110. Preferably, the second platen includes two stops such as 117 arranged on either side of the rail 115.

Alternatively, from the second position to the first position, the movement can be limited by a tongue 120 participating in the outer circumference of the first platen 101 and making contact with a rim 118 formed in the second platen, on the same side as the stops 117. A boss 150 provided on the upper surface 109 of the second platen 103 creates a holding point which tends to maintain this first position. This boss 150 arranged at the upper surface 109, on a side of the axis X opposite that presenting the stops 117, engages with the inner surface of the flange 119.

The usefulness of this second platen 103 which is movable relative to the first platen is attributable to the presence of at least one second recess 121 emerging via a second opening 160 at the upper surface 109. Preferably, this second platen 103 presents a series 122 of recesses such as 121. As the second platen also extends along the longitudinal axis X, the recesses of the series 122 are arranged side by side along this axis X and respectively emerge via openings accessible from the upper surface 109.

In particular, the upper surface 109 in the illustrated example is divided into at least two, or preferably three, successive portions along axis X. These portions are for example defined in different, but nonetheless mutually parallel, planes. Correspondingly, the lower surface 10 presents a counterpart surface.

In the illustrated example, in the first position, the first platen is arranged above the second platen such that the lower surface 10 conceals the recesses of the second series 122, and in particular the respective openings of these recesses, and advantageously seals them respectively in a leaktight manner.

The recesses such as 4 of the first series 105 are themselves concealed by the cover 20 when the latter is assembled on the body 2. In this assembled position, the recesses of the series 105 are preferably closed in a leaktight manner.

The applicator component 102 of the cover 20 includes an elongated handle 26 such that an applicator element 24 is presented at one axial end 23 thereof. In the assembled position, the applicator element 24 is inserted into the third recess 1, above the sectional plane 6. Preferably, a light force fit is employed to insert this applicator element 24 inside the edge delineating the opening 12 of this third recess 11. The applicator element 24 is presented for example in the form of a foam block formed at the end of a rod 25. As noted earlier, the applicator element can be provided in other forms. The applicator element 24 and the rod 25 are arranged such that, when the body 2 and cover 20 are in the assembled position, as illustrated in FIG. 1, they are inserted into the third recess 11 of the body 2. The rod 25 in this example includes a lug 123 capable of snapping into a counterpart projection or recess 124 formed in the third recess 11 to participate in maintaining this assembled position.

In this assembled position depicted in FIG. 1, the applicator device 1 has a substantially slender shape, including at least one plane of symmetry. In particular the axial ends of the device 1, relative to the longitudinal axis X, correspond substantially to the axial ends 125 and 126 of the body 2. In the illustrated example, the ends are bevelled; mutually parallel, and oblique relative to the axis X.

Preferably, the assembled position can only be obtained when the second platen 103 is arranged under the first platen 101, i.e. with the body 2 in the first position. In fact, at the axial end 126, opposite the axial end 125 at which the third recess 11 is presented, the handle 26 includes a wall 127, oblique relative to the axis of elongation of the handle, capable of cooperating by reversible force-fit with a counterpart shape 128 formed in the body 2. In the assembled position, the wall 127 defines the axial end of the device 1 opposite the axial end 126 which also forms the axial end of the device 1.

The counterpart shape 128 includes a first projection 129 presented by the first platen 101 and a second projection 130 presented by the second platen 103. When the first and second platens 101 and 103 are superimposed, the first and second projections 129 and 130 are then arranged so that they present a counterpart shape 128 capable of cooperating with the wall 127. By way of example, the wall 127 is capable of gripping the external outline of the two projections 129 and 130, for example with a recess and/or one or more edges associated with the wall. In particular, in the illustrated example, the wall 127 grips the side walls parallel to the longitudinal axis X of these two projections. When the cover 20 is fitted, it is then impossible to move the body 2 to its second position, the first and second platens 101 and 103 being held fast in said first position by the wall 127. In this assembled position, the wall 127 also participates in defining the external outline of the device 1.

Figure 3:
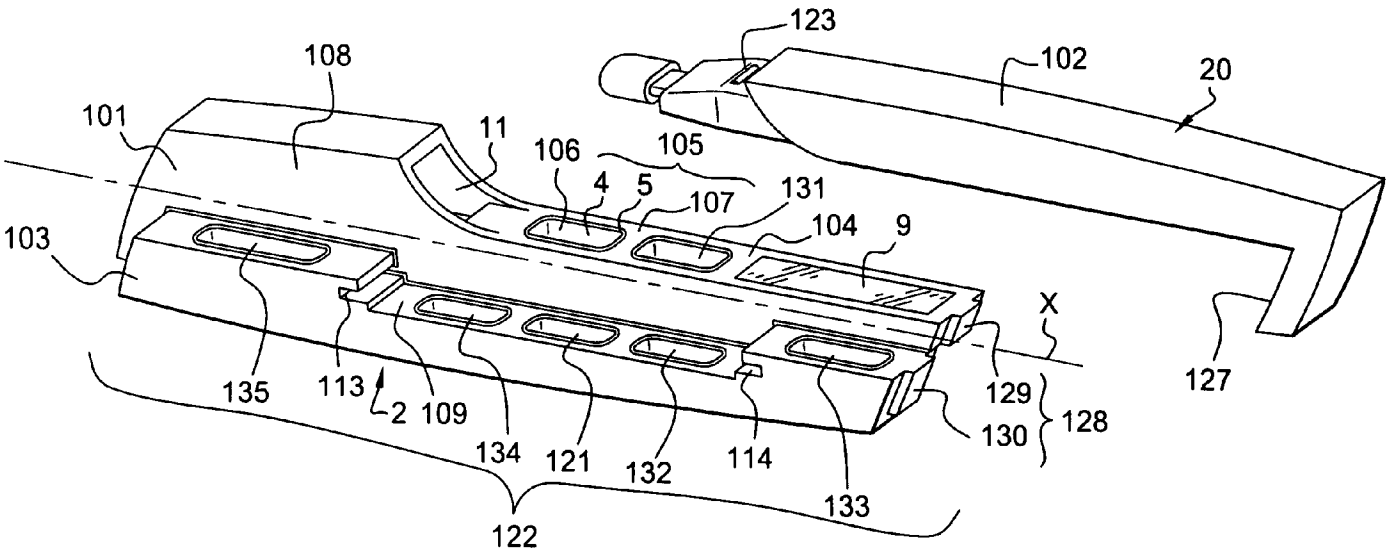
FIG. 3 is a perspective view of a device according to the invention in an open position.
Figure 4:
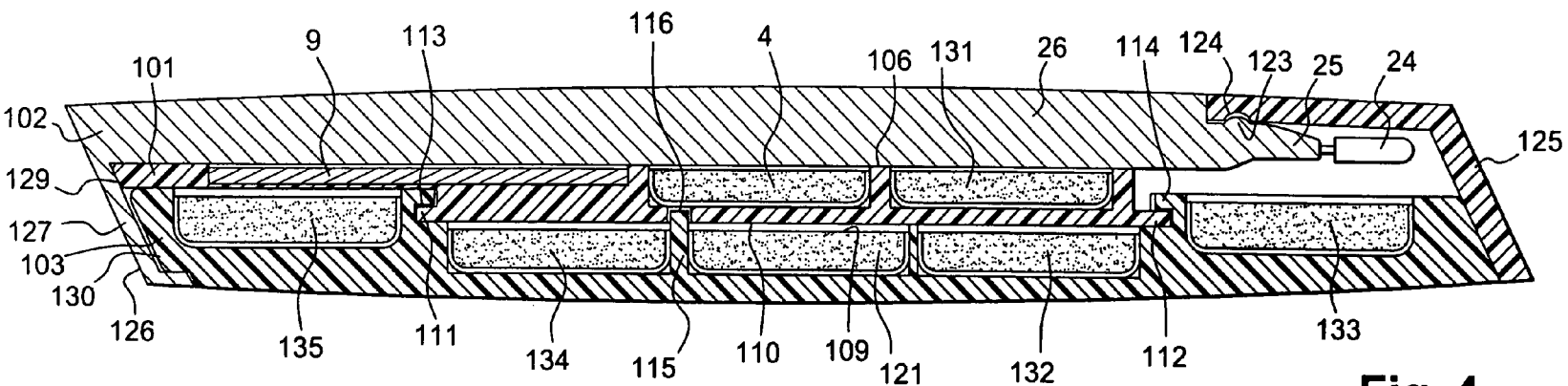
FIG. 4 is a longitudinal sectional view on a principal axis of elongation of the device according to the invention in its assembled position.
Figure 5:
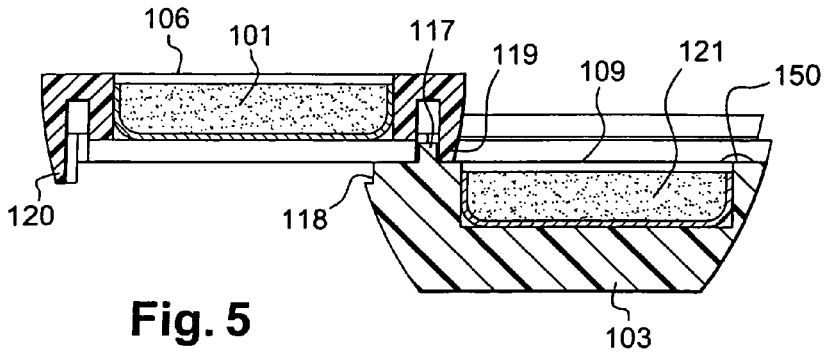
FIG. 5 is a transverse sectional view on a principal axis of elongation of the device according to the invention in an open position.

When the body 2 is in the second position, as depicted in FIG. 3, the user cannot mount the cover 20 on the first platen 101 because one edge of the wall 127 bears against the second projection 130 and prevents the applicator portion 24 from snapping into the third recess 11. In fact, in the second position, the projections 129 and 130 are offset and they do not therefore present the shape 128.

Figure 2:
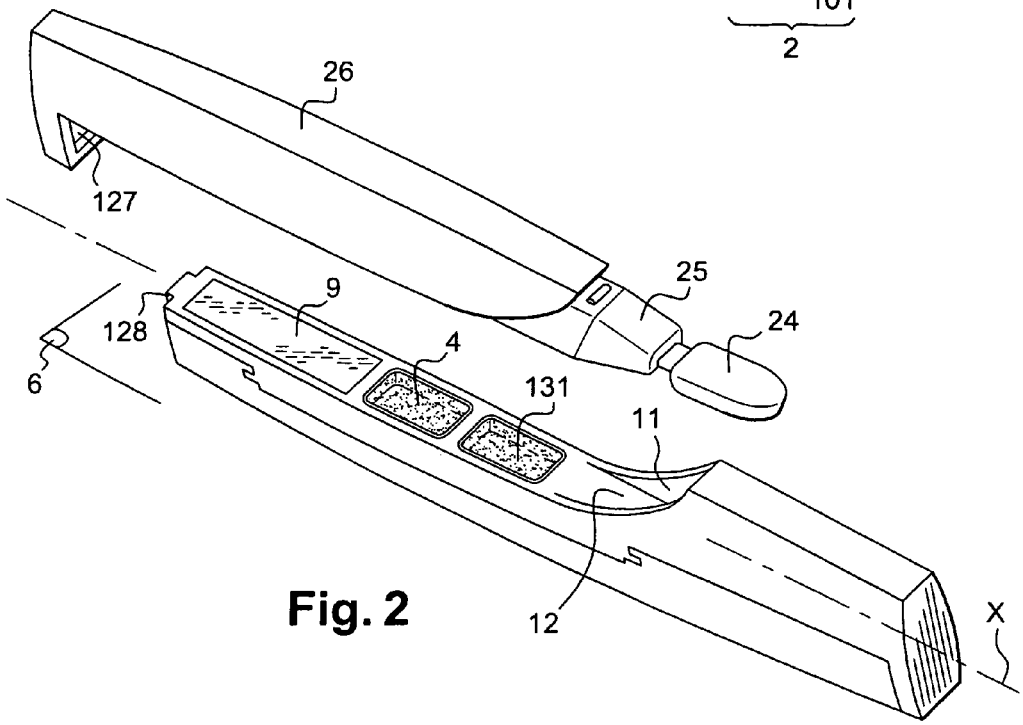
FIG. 2 is a perspective view of a device according to the invention in a semi-open position.

To use the applicator device 1 according to this embodiment, the user exerts a pulling movement on the cover 20 relative to the body 2, so as to cause, by a sliding motion along axis X, mutual disengagement of the attachment arrangement formed by the snap-on arrangement 123 and 124 and the gripping arrangement 127 and 128. In so doing, the applicator element 24 is withdrawn from the third recess 11. The free surface of the product contained in the first recess 4 is directly accessible, as illustrated in FIG. 2. Holding the applicator by the handle 26, the user takes up product contained in the cup 5 by means of the applicator element 24. She then applies it to the surface to be treated in a conventional manner.

In the case where the user wishes to obtain a sophisticated makeup effect based on several shades, she can also use the applicator element 24 to take up other products arranged in the other recesses such as 4 of the first series 105. In addition to this makeup, the user can also move the second platen 103 to the second position, thereby gaining access to recesses such as 121 of the second series 122 of recesses. The user then has access to the two shades contained in the two recesses 4 and 131 of the first series 105, plus five more shades, possibly different, contained in the recesses 121 and 132 to 135 of the second series 122.

The third recess 11 emerges preferably at the lower surface 110, when the body 2 is placed in the second position, and the user is therefore able to move her forefinger from the lower surface 110 into the third recess 11. The user thus has the benefit of a secure manual grasp on the device 1 thus opened, while at the same time avoiding contact between the products contained in the different product recesses and her fingers. The manual hold can be obtained between thumb and forefinger, the thumb in this instance resting on the external surface of the second portion 108 of the first platen 101 partly delineating the third recess 11.

With a compact applicator device 1 according to the invention, the user can have access to seven different shades, for example, with the illustrated arrangement. In addition, she can use the mirror 9 to obtain a sophisticated makeup finish anywhere, for example in locations other than in a bathroom.

After applying makeup, the user returns the body 2 to its first position and replaces the applicator element 24 inside the third recess 11 by sliding the cover 20 on axis X relative to the body 2, until the elements of the attachment arrangement are engaged once more. The device is then ready for further use, and can be readily carried in a handbag with no risk of inadvertent opening.

Figure 6:
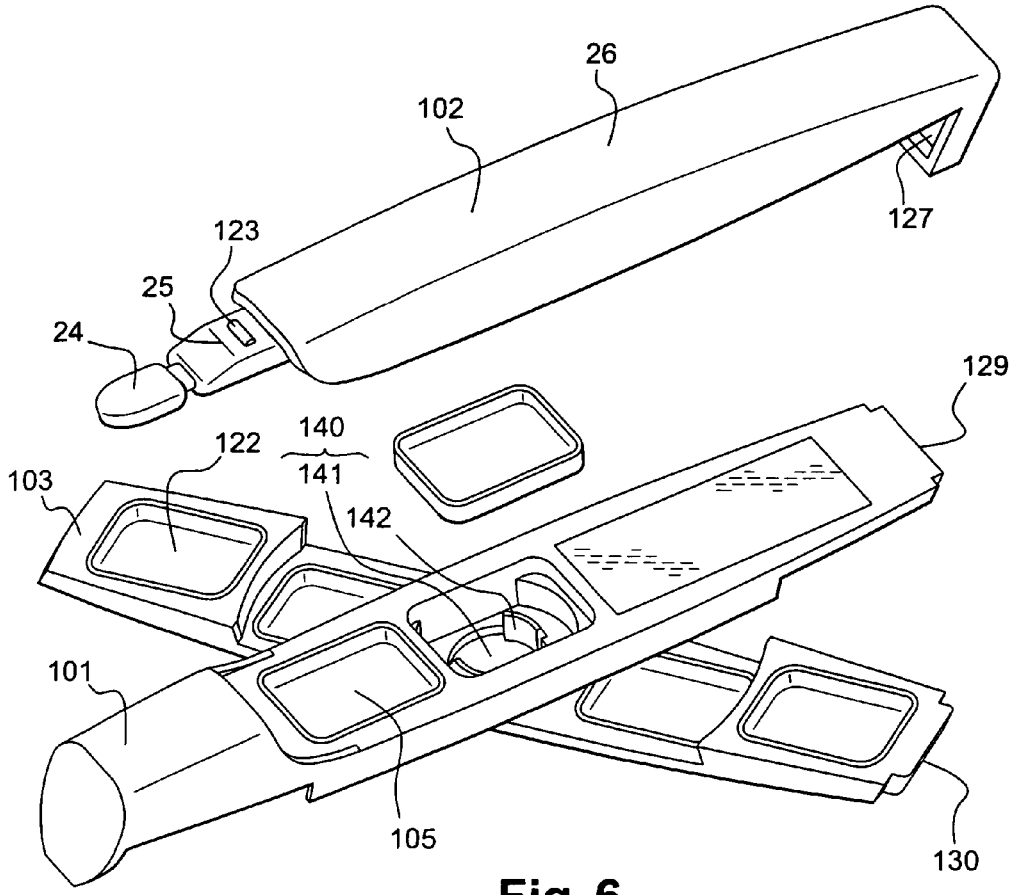
FIG. 6 is a perspective view of an alternative embodiment of the device according to the invention in an open position.

The embodiment in FIG. 6 differs from the previous embodiment in that the second platen 103 is rotatably mounted relative to the first platen 101. By way of example, in the arrangement illustrated, a pivot 140 extending from the second platen 103 extends through an aperture 141 in the first platen 101. The pivot 140 includes for example flexible tabs 142 arranged so as to delineate a cylinder enabling the rotational movement, these tabs allowing the pivot 140 to snap into the aperture 141.

In the case where the device 1 does not have a central axis of symmetry passing through the pivot axis, and where the upper surface 109 of the second platen is not flat, but includes several levels, the second platen can then be made to rotate through less than a full revolution, for example between 0° and 280° relative to the first platen. The first position corresponds to the angular position 0° in which the first and second platens are superimposed one on the other. The second position corresponds, for example, to the position at 90°, at which the overlap of the second platen by the first is minimal, and the accessible upper surface 109 is therefore maximised.

For example, the aperture 141 can be closed off by a cup of product. In this case, a device according to this "pivoting" embodiment can include, for example, two recesses in the first series 105 and four recesses in the second series 122. A mirror such as 9 can also be provided at the upper surface 107.

As a variant, the pivot can be formed at a distance from a median zone, for example in proximity to a distal zone of the body 2. Nevertheless, a preferred embodiment of the connection between the first and second platens aims to minimize the existence of an overhang or overlap between these platens when they are in the second position. It is presently preferred to provide the axis of rotation of the pivot 140 at some distance from the axial ends 125 and 126. The pivot 140 is respectively placed at a distance from each of these two ends greater than 1/10th, preferably greater than 1/3rd and more preferably greater than half the axial length of the body 2.

In this pivoting embodiment, as in the first embodiment, in order to obtain the assembled position, it is necessary for the first and second platens to be superimposed and the counterpart shape 128 must be presented so that the wall 127 can cooperate therewith.

Throughout the description, the expressions such as "including one," "comprising one," "has one" and "having one" should be regarded as synonymous with "including at least one", unless specified otherwise, and the same is also true for expressions with other numerical values such as "including two."

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A device for packaging and applying at least one cosmetic product, comprising a body including a first platen delineating at least one first recess containing a first product, and a second platen delineating at least one second recess containing a second product, said body further including a mounting arrangement between the first platen and the second platen, said mounting arrangement including a first part which is part of said first platen and a second part which is part of said second platen and wherein said first part engages with said second part such that said first platen is in contact with and directly coupled to said second platen, and wherein said mounting arrangement movably mounts said first and second platens relative to each other such that said first platen is movable relative to said second platen;

an applicator component which includes an applicator element arranged at one end of a handle, wherein said applicator component is detachably mountable to the body, so that said applicator component can be moved between a mounted position in which the applicator component is mounted to the body and a detached position in which the applicator component is detached from the body;

wherein said device is configured so that, when the applicator component is in the mounted position on the body, movement of the first platen relative to the second platen is restricted, and so that when the applicator component is in the detached position, the first platen is movable relative to the second platen.

2. A device according to claim 1, wherein said applicator component includes a portion which extends over part of each of said first platen and said second platen in the mounted position, and wherein said portion holds the first platen immobilized relative to the second platen in the mounted position.

3. A device according to claim 2, wherein with respect to a lengthwise direction said device includes first and second ends, and wherein said portion of said applicator forms said first end in the mounted position.

4. A device according to claim 3, wherein said first platen forms said second end, and wherein a third recess is associated with said first platen and receives said applicator element in said mounted position.

5. A device according to claim 4, wherein when said applicator component is in the detached position said second platen is movable relative to said first platen between a closed position and an open position, and wherein in said closed position said first platen covers said second recess and in said open position said second recess is exposed.

6. A device according to claim 5, wherein said applicator component covers said first recess in the mounted position.

7. A device according to claim 1, wherein said handle of said applicator component includes a first end, and wherein the first and second platens each include respective first and second ends, and further wherein in the mounted position of the applicator component the first end of the handle extends over the first end of the first platen and the first end of the second platen to restrict movement of the first platen relative to the second platen.

8. A device according to claim 1, wherein one of said first part and said second part includes at least one protrusion and the other of said first and second parts includes at least one recess which receives the at least one protrusion.

9. A device according to claim 8, wherein said at least one protrusion is provided on a bottom portion of said first platen and said at least one indentation is provided on a top portion of said second platen and wherein said first platen mates with said second platen by way of said at least one protrusion and said at least one indentation.

10. A device for packaging and applying at least one cosmetic product, comprising a) a first platen which delineates a first recess containing a first product to be applied, wherein said first recess includes a first opening;

b) a second platen which is movable relative to the first platen and which delineates at least one second recess containing a second product to be applied, wherein said second recess includes a second opening;

c) a detachable applicator component which includes an applicator element arranged at one end of a handle;

wherein in an assembled position of the first and second platens and the applicator component, the first platen is in contact with the second platen and covers the second opening and the applicator component is in contact with the first platen and covers the first opening; and wherein when the applicator component is in a detached position relative to the first platen, the second platen is movable to an offset position relative to the first platen in which at least the second opening is accessible for take-up of the second product.

11. A device according to claim 10, further including means preventing assembly of the applicator component with the first platen when the second opening is not covered by the first platen, and wherein access to the second opening is prevented when the device is in the assembled position.

12. A device according to claim 11, wherein in the assembled position the device is in a closed position such that the first and second openings are inaccessible.

13. A device according to claim 10, wherein when the applicator component is in a detached position relative to the first platen, at least the first opening is accessible for take-up of the first product.

14. A device according to claim 10, wherein the handle defines a portion of an external surface of the device.

15. A device according to claim 10, wherein the first opening extends substantially in a first plane, and wherein in the assembled position said applicator element is arranged via a third opening in a third recess on a side of the first plane opposite the first recess.

16. A device according to claim 10, wherein the second opening extends substantially in a second plane parallel to a first plane in which the first opening extends.

17. A device according to claim 10, wherein a section of the handle in a plane parallel to a plane of the first opening has a size greater than or equal to a size of the first opening, so that the handle can be superimposed to entirely cover the first opening in the assembled position.

18. A device according to claim 10, wherein in the assembled position the handle closes off said first opening in a leaktight manner.

19. A device according to claim 10, wherein a section of the first platen in a plane parallel to a plane of the second opening is greater than or equal to a section of the second opening, so that the first platen can be superimposed to entirely cover the second opening.

20. A device according to claim 10, wherein in the assembled position the first platen closes off said second opening in a leaktight manner.

21. A device according to claim 10, wherein in the assembled position the handle covers the entire reflective surface of a mirror which is disposed on the first platen.

22. A device according to claim 21, wherein the mirror is movable between a position in which it at least partially covers the first opening and a position in which the mirror does not cover the first opening.

23. A device according to claim 21, wherein the mirror is fixedly mounted on the first platen adjacent to said first opening.

24. A device according to claim 22, wherein the mirror is movable with a sliding movement relative to the first platen.

25. A device according to claim 22, wherein the mirror is movable with a pivoting movement relative to the first platen.

26. A device according to claim 10, wherein the device includes a longitudinal axis (X) along which is arranged a first series of recesses formed in the first platen.

27. A device according to claim 26, wherein the recesses of the first series each extend along said longitudinal axis (X).

28. A device according to claim 10, wherein the second platen includes a second series of recesses.

29. A device according to claim 10, wherein the platens and the applicator component are each respectively formed from a single piece obtained by moulding.

30. A device according to claim 10, wherein the applicator element is axially fixed relative to the handle.

31. A device according to claim 10, further including a slide coupling between the first platen and the second platen to allow relative sliding movement of the second platen relative to the first platen.

32. A device according to claim 10, further including a pivot coupling between the first platen and the second platen to allow relative rotating movement of the second platen relative to the first platen.

33. A device according to claim 10, wherein a reversible locking action of the assembled position is provided by a snap attachment or force fit between the applicator component and at least one of said first and second platens.

34. A device according to claim 10, wherein in the assembled position the device has a cross-section having an outer periphery with a shape selected from the group consisting of: a circle, a hexagon, a square, an oval and a rectangle.

35. A device according to claim 10, wherein the applicator element is formed of at least one material selected from the group consisting of: a block of open foam, a semi-open foam, a closed-cell foam, a felt, an agglomerate material, a ceramic, a thermoplastic, and an arrangement of bristles.

36. A device according to claim 10, wherein at least one of the first and second products is contained inside a cup arranged inside a recess.

37. A device according to claim 36, wherein the cup is detachable.

38. A device according to claim 10, wherein the product is in the form of a solid or semi solid bar.

39. A device according to claim 10, wherein at least one of the first and second products is selected from the group consisting of: an eyeshadow, a blusher, a foundation, a lip color, and a mascara.

40. A device according to claim 10, wherein the first and second products are make-up products.

41. A device according to claim 10, wherein said first platen includes a third recess which receives the applicator element in the assembled position.

42. A device according to claim 41, wherein with respect to a first direction transverse to a lengthwise direction of the device, said device includes a first external side and a second external side on a side opposite the first external side, and wherein said first external side is formed by part of said applicator component and part of said first platen and said second external side is at least partially formed by said second platen.

43. A device according to claim 42, wherein with respect to a second direction transverse to said lengthwise direction, said device further includes a third external side and a fourth external side on a side opposite the third external side, and wherein each of said third and fourth external sides are at least partially formed by part of each of said applicator component, said first platen, and said second platen.

44. A device according to claim 10, wherein when said applicator component is detached, the second platen is movable relative to the first platen between a closed position in which said first platen covers said second opening and an open position in which said second opening is exposed so that the applicator element can remove the second product from the second recess.

45. A device according to claim 10, wherein the device further include a mounting arrangement between the first platen and the second platen, said mounting arrangement including a first part which is part of said first platen and a second part which is part of said second platen, and wherein said first part engages with said second part such that said first platen is in contact with and directly coupled to said second platen, and wherein said mounting arrangement movably mounts said first and second platens relative to each other such that said first platen is movable relative to said second platen when the applicator component is detached.

46. A device according to claim 45, wherein the first and second platens each include a first end, and wherein in the assembled position the handle of the applicator component extends over the first end of the first platen and the first end of the second platen to restrict movement of the first platen relative to the second platen in the assembled position.

47. A device according to claim 45, wherein one of said first part and said second part includes at least one protrusion and the other of said first and second parts includes at least one recess which receives the at least one protrusion.

48. A device according to claim 47, wherein said at least one protrusion is provided on a bottom portion of said first platen and said at least one indentation is provided on a top portion of said second platen and wherein said first platen mates with said second platen by way of said at least one protrusion and said at least one indentation.

49. A device for packaging and applying at least one cosmetic product, comprising:

a body elongated on a longitudinal axis, said body including a first platen extending at least partially in a plane and a second platen coupled directly to the first platen and extending parallel to said plane, and wherein the first and second platens each include first and second ends;

an applicator component including an applicator element arranged at one end of a handle, wherein said applicator component is detachably mountable to the body so that the applicator component can be moved between a mounted position in which the applicator component is mounted to the body and a detached position in which the applicator component is detached from the body;

wherein said device is configured so that, when the applicator component is in the mounted position on the body, the handle is coupled to the first ends of each of the first and second platens such that the first platen is immobilised relative to the second platen, and so that, in the detached position, the first platen is movable between a first position and a second position relative to the second platen according to a rotational movement about an axis spaced from said first and second ends of said first and second platens; and wherein in said first position said first platen is aligned with said second platen, and wherein in said second position said first platen is rotationally offset from the second platen with the first end of the first platen offset from the first end of the second platen and with the second end of the first platen offset from the second end of the second platen, and further wherein a first portion extends between the axis and the first end of each of the first and second platens and a second portion extends between the axis and the second end of each of the first and second platens, and wherein at least one of said first and second platens includes a mirror or a recess containing a product in the first portion and a recess containing a product in the second portion.

50. A device according to claim 49, wherein the first platen includes a mirror in the first portion and a recess containing a product in the second portion, and further wherein the second platen includes a recess containing a product in the first portion and a recess containing a product in the second portion.

51. A device according to claim 50, wherein said second platen includes plural recesses each containing a product in the first portion and plural recesses each containing a product in the second portion.

52. A device according to claim 51, wherein the products in each of the recesses of the first and second platens are contained in cups positioned in said recesses.

* * * * *